US012502578B1

(12) United States Patent
Liu

(10) Patent No.: US 12,502,578 B1
(45) Date of Patent: Dec. 23, 2025

(54) HAND GRIPPER

(71) Applicant: Yu Liu, Beijing (CN)

(72) Inventor: Yu Liu, Beijing (CN)

( * ) Notice: Subject to any disclaimer, the term of this patent is extended or adjusted under 35 U.S.C. 154(b) by 0 days.

(21) Appl. No.: 19/296,863

(22) Filed: Aug. 11, 2025

(30) Foreign Application Priority Data

Jul. 4, 2025 (CN) ..... 202521408105.0

(51) Int. Cl.
*A63B 23/16* (2006.01)
*A63B 21/00* (2006.01)
*A63B 21/045* (2006.01)

(52) U.S. Cl.
CPC ..... *A63B 23/16* (2013.01); *A63B 21/00072* (2013.01); *A63B 21/045* (2013.01)

(58) Field of Classification Search
CPC ..... A63B 23/16; A63B 21/045
See application file for complete search history.

(56) References Cited

U.S. PATENT DOCUMENTS 4,262,898 A * 4/1981 Lee ..... G06M 1/083 235/117 A
4,943,047 A 7/1990 Noble
5,488,755 A 2/1996 Chang
6,881,177 B2 4/2005 An
10,688,340 B1 * 6/2020 Aldredge ..... A63B 21/0421
10,898,749 B2 * 1/2021 Ju ..... A63B 23/16
2004/0003687 A1 * 1/2004 An ..... A63B 21/0004 606/206
2008/0103026 A1 * 5/2008 An ..... A63B 21/023 482/49
2010/0255956 A1 * 10/2010 An ..... A63B 23/16 482/49
2014/0038786 A1 * 2/2014 Garcia ..... A63B 21/00069 482/49
2019/0255383 A1 * 8/2019 An ..... A63B 21/00072
2022/0072369 A1 * 3/2022 Van Willigen ..... A63B 21/0428
2024/0123282 A1 * 4/2024 Lu ..... A63B 21/0421

FOREIGN PATENT DOCUMENTS

CN 209237267 U * 8/2019
CN 209933979 U * 1/2020

* cited by examiner

*Primary Examiner* — Joshua T Kennedy

(57) ABSTRACT

A hand gripper includes an elastomer, a first grip portion, a second grip portion, an axial rod, and a locking member. The first grip portion and the second grip portion each has one end connected to the elastomer and another end to form a free end. An axis of the first grip portion and an axis of the second grip portion form an angle. When the angle changes, the elastomer undergoes elastic deformation. An adjustment hole is formed in the second grip portion. One end of the axial rod is connected to the first grip portion, and another end of the axial rod extends in a direction towards the second grip portion to movably pass through the adjustment hole. The locking member can be locked at different positions along the axial rod to abut against the second grip portion or unlock from the axial rod.

18 Claims, 3 Drawing Sheets

HAND GRIPPER

RELATED APPLICATIONS

The present patent document claims the benefit of priority to Chinese Patent Application No. 2025214081050, filed on Jul. 4, 2025, and entitled "HAND GRIPPER," the entire contents of each of which are incorporated herein by reference.

BACKGROUND

1. Technical Field

The present disclosure relates to the field of fitness devices, and in particular, to a hand gripper.

2. Background Information

A hand gripper, also known as an arm gripper or a finger strengthener, is a compact fitness device used to strengthen wrists and arms, and is favoured by people due to its small size, light weight, portability, and unrestricted exercises regardless of time and space.

A conventional hand gripper generally includes a torsion spring and two handles. The two handles each have one end fixedly connected to the torsion spring, and the other end extending in a direction away from the torsion spring to form an angle. A distance between tail ends of the two handles defines a closing range of the hand gripper, also known as a grip span. A user may press the two handles with one or both hands, causing the hand gripper to close, thereby achieving the purpose of exercise. However, in the conventional hand gripper, the grip span is usually fixed. Therefore, for some special users with small hands or those with palm injuries that prevent them from fully opening their palms, they are unable to perform single-handed grip training, limiting the application range of the hand gripper.

BRIEF SUMMARY

An embodiment of the present disclosure provides a hand gripper that achieves an adjustable grip span of the hand gripper, thereby expanding the application range of the hand gripper.

A first aspect of the embodiment of the present disclosure provides a hand gripper, including: an elastomer; a first grip portion and a second grip portion each having one end connected to the elastomer, and the other end extending in a direction away from the elastomer to form a free end, an axis of the first grip portion and an axis of the second grip portion form an angle, the elastomer undergoing elastic deformation in response to the angle being changed, and an adjustment hole is formed in the second grip portion; an axial rod having one end connected to the first grip portion, and the other end extending in a direction towards the second grip portion to movably penetrate through the adjustment hole; and a locking member capable of being locked at different positions along the axial rod to abut against the second grip portion or unlocked from the axial rod, and abutting against one side of the second grip portion away from the first grip portion.

In some implementations, the axial rod is provided with threads, and the locking member includes a nut threadedly assembled with the axial rod.

In some implementations, the locking member further includes a safety block, the safety block is threadedly assembled with the axial rod and located on one side of the nut distal from the second grip portion, and the safety block has greater axial and radial dimensions than the nut.

In some implementations, the axial rod and the first grip portion are detachably assembled.

In some implementations, an assembly hole is formed in the first grip portion, the hand gripper further includes a limiting block connected to the axial rod, the axial rod movably penetrates through the assembly hole, and when the axial rod and the locking member are locked, the limiting block abuts against one side, of the first grip portion away from the second grip portion.

In some implementations, a threaded polygonal socket is further formed in the limiting block, and located in one side of the limiting block away from the axial rod.

In some implementations, the axial rod is connected to both the first grip portion and the second grip portion through knuckle bearings.

In some implementations, the elastomer is a torsion spring, and the first grip portion and the second grip portion are fixedly connected to the torsion spring.

In some implementations, surfaces of both the first grip portion and the second grip portion are provided with anti-slip patterns.

BRIEF DESCRIPTION OF THE DRAWINGS

The accompanying drawings in the specification, which form a part of the present disclosure, are used for providing a further understanding of the present disclosure, and illustrative embodiments of the present disclosure and explanations thereof are used for explaining the present disclosure, but do not improperly limit the present disclosure. In the figures.

Figure 1:
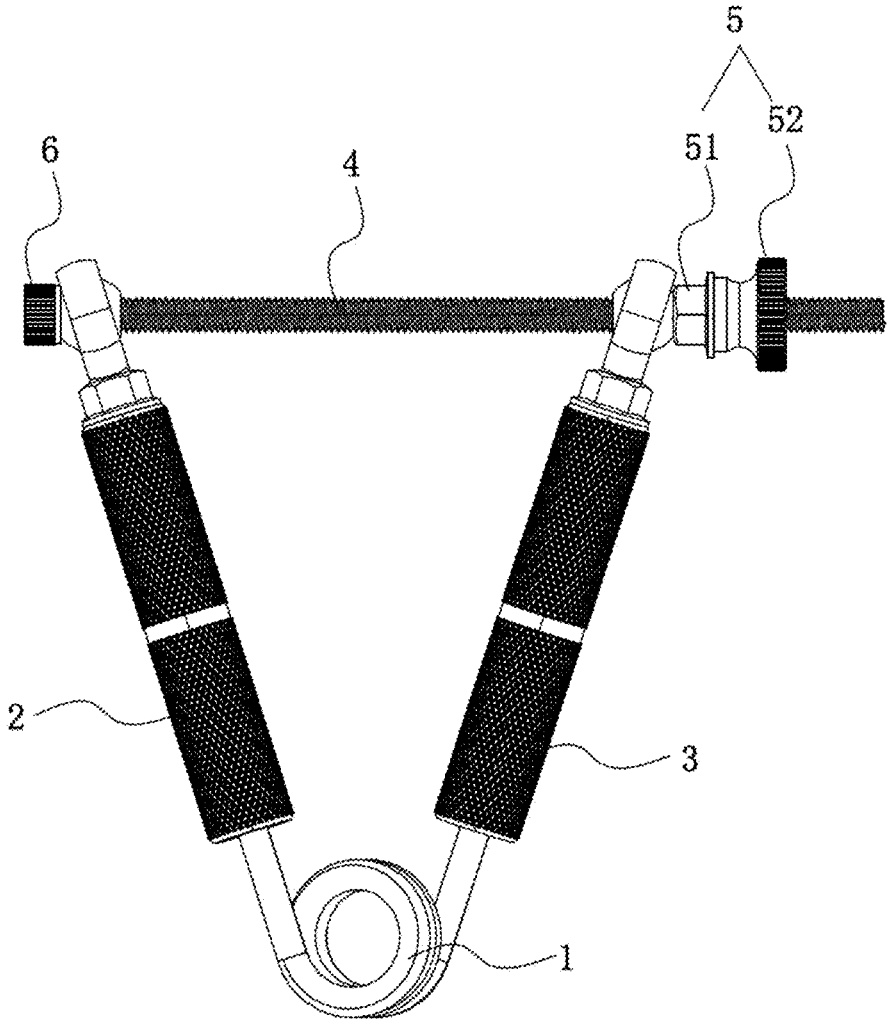
FIG. 1 is a perspective view of a hand gripper according to an embodiment of the present disclosure.

Description of reference numerals: 1—elastomer; 2—first grip portion; 21—assembly hole; 3—second grip portion; 31—adjustment hole; 4—axial rod; 5—locking member; 51—nut; 52—safety block; 6—limiting block; and 61—threaded polygonal socket.

DETAILED DESCRIPTION OF THE DRAWINGS AND THE PRESENTLY PREFERRED EMBODIMENTS

The present disclosure is described in detail with reference to the accompanying drawings and in combination with the embodiments Each example is provided by way of explanation of the present disclosure and is not intended to limit the present disclosure. In fact, those skilled in the art should understand that modifications and variations may be made within the present disclosure without departing from the scope or spirit of the present disclosure. For example, features illustrated or described as part of one embodiment may be used in another embodiment to yield yet a further embodiment. Therefore, it is intended that the present disclosure includes such modifications and variations that fall within the scope of the appended claims and equivalents thereof.

In the description of the present disclosure, terms such as "longitudinal", "transverse", "upper," "lower," "front,"

"rear," "left," "right," "vertical," "horizontal," "top," and "bottom" indicate orientational or positional relationships based on those shown in the accompanying drawings, are used merely for convenience in describing the present disclosure, and do not require the present disclosure to be constructed and operated in a specific orientation, and thus should not be construed as limiting the present disclosure. The terms "connected," "joined," and "arranged" as used in the present disclosure should be understood in a broad sense. For example, they may refer to fixed connection, or detachable connection; they may refer to direct connection or indirect connection through an intermediate component; or they may refer to wired electrical connection, wireless electrical connection, or wireless communication signal connection. Those of ordinary skill in the art may understand specific meanings of the above-mentioned terms according to specific situations.

One or more examples of the present disclosure are illustrated in the accompanying drawings. The detailed description uses numerical and alphabetical labels to refer to the features in the accompanying drawings. Similar or analogous labels in the accompanying drawings and descriptions have been used to refer to similar or analogous parts of the present disclosure. As used herein, the terms "first," "second," "third," etc., are interchangeably used to distinguish one component from another and are not intended to indicate the position or importance of individual components.

The present disclosure provides a hand gripper that may be used by a user to perform wrist and arm strength training.

Figure 2:
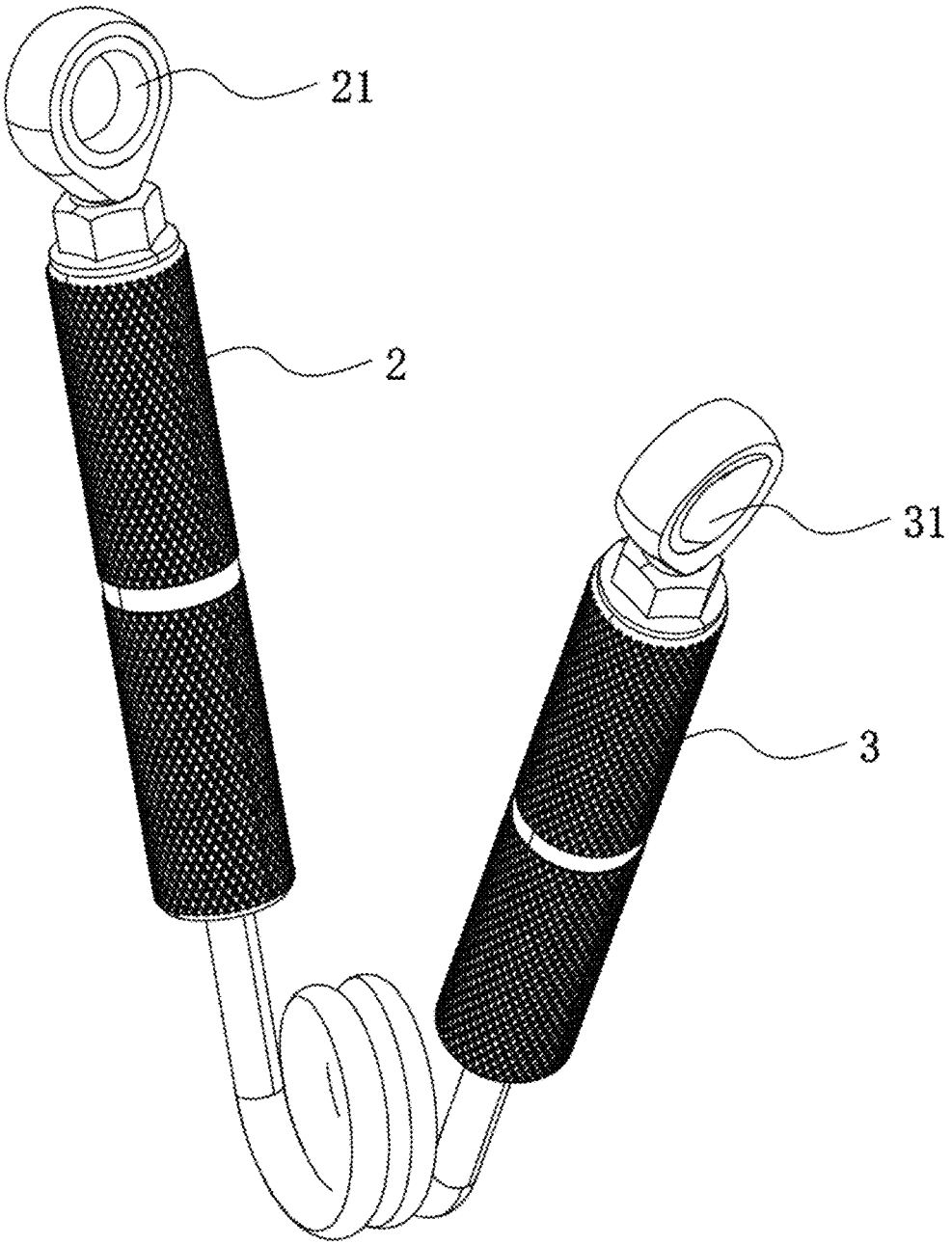
FIG. 2 is a partial perspective view of a hand gripper according to an embodiment of the present disclosure.

Referring to FIG. 1 and FIG. 2, in an embodiment, the hand gripper includes an elastomer 1, a first grip portion 2, a second grip portion 3, an axial rod 4, and a locking member 5.

Specifically, the first grip portion 2 and the second grip portion 3 each having one end connected to the elastomer 1, and the other end extending in a direction away from the elastomer 1 to form a free end. An axis the first grip portion 2 and an axis of the second grip portion 3 form a non-zero angle. When an external force causes the angle to change, the elastomer 1 undergoes elastic deformation. An adjustment hole 31 is formed in the second grip portion 3. One end of the axial rod 4 is connected to the first grip portion 2, and the other end of the axial rod 4 extends towards a direction where the second grip portion 3 is located to movably penetrate through the adjustment hole 31. The locking member 5 may be locked at different positions along the axial rod 4 to abut against the second grip portion 3 or unlocked from the axial rod 4. The locking member 5 abuts against one side of the second grip portion 3 distal from the first grip portion 2.

According to the hand gripper provided in this embodiment, the arrangement of the axial rod 4 and the locking member 5 enables the locking member 5 to abut the second grip portion 3 against the different positions along the axial rod 4, thereby changing the angle formed by the axes where the first grip portion 2 and the second grip portion 3 are located, and further adjusting a distance (e.g. a grip span) between the free ends of the first grip portion 2 and the second grip portion 3. In other words, when a user wants to perform grip training with the hand gripper provided in this embodiment, the locking member 5 may be first locked at a suitable position along the axial rod 4 according to their hand size. Under the abutting action of the locking member 5, the maximum opening distance between the first grip portion 2 and the second grip portion 3 is limited to adapt to a hand shape of the user without affecting the opening and closing of the hand gripper. The user may then grip the first grip portion 2 and the second grip portion 3 together or release them apart to perform training. The hand gripper may accommodate people with different needs, thereby expanding the applicable range of the hand gripper and making it especially beneficial for individuals with special needs.

Continue to refer to FIG. 1, in an embodiment, the elastomer 1 is a torsion spring. The first grip portion 2 and the second grip portion 3 each have one end directly connected to the torsion spring and the other end extending in a direction away from the torsion spring to form a free end. That is, the first grip portion 2 and the second grip portion 3 are only connected through the torsion spring. This arrangement enables the hand gripper to be manufactured as an integrated structure from the same material, simplifying the production process and resulting in a simple and practical structure. In other embodiments, the elastomer 1 may also be a compression spring. Meanwhile, one end of the first grip portion 2 is hinged to one end of the second grip portion 3, and the other end of the first grip portion 2 and the other end of the second grip portion 3 are free ends. One end of the compression spring is connected to the first grip portion 2, and the other end of the compression spring is connected to the second grip portion 3. That is, the first grip portion 2, the second grip portion 3, and the compression spring cooperate with each other to form an "A" shape. It should be understood that whether the elastomer 1, the first grip portion 2, and the second grip portion 3 are directly or indirectly connected is not restricted, as long as the connection achieves a basic function of the hand gripper.

Continue to refer to FIG. 1, in an embodiment, the axial rod 4 is provided with threads, and the locking member 5 includes a nut 51 threadedly assembled with the axial rod 4. This arrangement enables the locking of the locking member 5 to and unlocking of the locking member 5 from the axial rod 4 through threaded engagement, making the grip span adjustment of the hand gripper simpler and more convenient. Moreover, the nut 51 may be locked at any position along a threaded section of the axial rod 4, enabling finer adjustment precision and expanding the applicability of the hand gripper. In other embodiments, the locking between the locking member 5 and the axial rod 4 may also be achieved through detachable snap-fit engagement. For example, snap-fit holes may be equidistantly formed in the axial rod 4, and the locking member 5 includes a snap-fit block. The adjustment of the second grip portion 3 is adjusted through snap fit of the snap-fit block in the different snap-fit holes.

Continue to refer to FIG. 1, in an embodiment, the locking member 5 further includes a safety block 52. The safety block 52 is also threadedly assembled with the axial rod 4 and located on one side of the nut 51 away from the second grip portion 3. The safety block 52 has greater axial and radial dimensions than the nut 51. The arrangement of the safety block 52 can further enhance a blocking effect on the second grip portion 3, thereby making the grip span adjustment of the hand gripper more stable.

Continue to refer to FIG. 1, in an embodiment, the axial rod 4 and the first grip portion 2 are arranged to be detachably assembled. This arrangement allows a user who does not need to adjust the grip span of the hand gripper may remove the axial rod 4 and the locking member 5 during training, thereby preventing the axial rod 4 or the locking member 5 from affecting the use of the hand gripper. In other embodiments, the axial rod 4 and the first grip portion 2 may also be arranged to be fixedly connected to prevent the loss of the axial rod 4. It should be understood that the specific connection between the axial rod 4 and the first grip portion 2 is not limited.

Continue to refer to FIG. 1 and FIG. 2, in an embodiment, an assembly hole 21 is formed in the first grip portion 2, and the hand gripper further includes a limiting block 6. The axial rod 4 movably penetrates through both the assembly hole 21 and the adjustment hole 31, and the limiting block 6 is connected to the axial rod 4. When the axial rod 4 penetrates through both the assembly hole 21 and the adjustment hole 31, the limiting block 6 abuts against one side of the first grip portion 2 away from the second grip portion 3.

The arrangement allows the axial rod 4 to penetrate through the assembly hole 21 and the adjustment hole 31 only when the grip span of the hand gripper needs to be adjusted, and the limiting block 6 abuts against the first grip portion 2. The locking member 5 is then locked at a suitable position along the axial rod 4 and abuts against the second grip portion 3, enabling the grip span to meet the user needs. The operation is simple and convenient.

Figure 3:
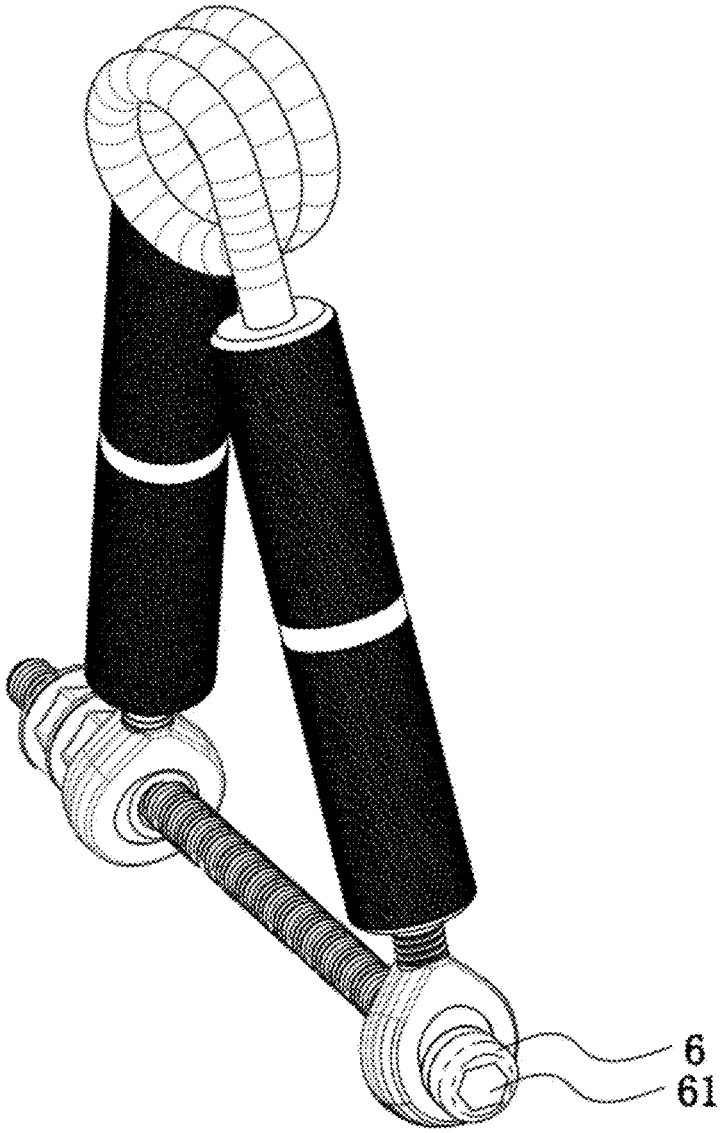
FIG. 3 is a perspective view of a hand gripper from another perspective according to an embodiment of the present disclosure.

As shown in FIG. 3, in an embodiment, a threaded polygonal socket 61 is further formed in the limiting block 6. Through the arrangement, a wrench that can fit into the threaded polygonal socket 61 may be used to be clamped within the threaded polygonal socket 61 for leverage when adjusting the hand gripper, thereby making it more convenient to lock the locking member 5. In an embodiment, the threaded polygonal socket 61 is a hexagon socket. In other embodiments, the threaded polygonal socket 61 may also be an octagon socket.

Continue to refer to FIG. 1, in an embodiment, the axial rod 4 is connected to both the first grip portion 2 and the second grip portion 3 through knuckle bearings, thereby facilitating smoother movement of the first grip portion 2 and the second grip portion 3 along the axial rod 4.

Referring to FIG. 2, in an embodiment, the assembly hole 21 is formed in a tail end of the free end of the first grip portion 2, and the adjustment hole 31 is formed in a tail end of the free end of the second grip portion 3, thereby reducing the impact on the use of the hand gripper. It should be understood that in other embodiments, the specific arrangement positions of the assembly hole 21 and the adjustment hole 31 are not limited.

Continue to refer to FIG. 2, in an embodiment, surfaces of both the first grip portion 2 and the second grip portion 3 are provided with anti-slip patterns.

Analysis reveals that according to the hand gripper provided in the utility model, the arrangement of the axial rod and the locking member enables the locking member to abut the second grip portion against different positions along the axial rod, thereby changing the angle between the first grip portion and the second grip portion, and further adjusting a distance between the free ends of the first grip portion and the second grip portion. This makes the grip span of the hand gripper become adjustable, allowing the hand gripper to accommodate people with different needs, thereby expanding the applicable range of the hand gripper.

The above-mentioned descriptions are merely some embodiments of the present disclosure and are not intended to limit the present disclosure. For those skilled in the art, the present disclosure may have various modifications and changes. Any modifications, equivalent replacements, improvements, etc., made within the scope of protection and principle of the present disclosure shall fall within the scope of protection of the present disclosure.

The invention claimed is:

1. A hand gripper, comprising:

an elastomer;

a first grip portion and a second grip portion each having one end connected to the elastomer and another end extending in a direction away from the elastomer to form a free end, wherein an axis of the first grip portion and an axis of the second grip portion form an angle, the elastomer undergoes elastic deformation in response to the angle being changed, and an adjustment hole is formed in the second grip portion;

an axial rod having one end connected to the first grip portion and another end extending in a direction towards the second grip portion to movably extend through the adjustment hole; and a locking member capable of being locked at different positions along the axial rod to abut against the second grip portion or unlocked from the axial rod, and the locking member abutting against one side of the second grip portion away from the first grip portion.

2. The hand gripper according to claim 1, wherein the axial rod is provided with threads, and the locking member comprises a nut threadedly assembled with the axial rod.

3. The hand gripper according to claim 2, wherein the locking member further comprises a safety block, the safety block is threadedly assembled with the axial rod and located on one side of the nut away from the second grip portion, and the safety block has greater axial and radial dimensions than the nut.

4. The hand gripper according to claim 3, wherein the axial rod and the first grip portion are detachably assembled.

5. The hand gripper according to claim 4, wherein an assembly hole is formed in the first grip portion, the hand gripper further comprises a limiting block connected to the axial rod, the axial rod is configured to movably extend through the assembly hole, and the limiting block abuts against one side of the first grip portion away from the second grip portion in response to the axial rod and the locking member being locked.

6. The hand gripper according to claim 5, wherein a threaded polygonal socket is further formed in the limiting block, and the threaded polygonal socket is located in one side of the limiting block away from the axial rod.

7. The hand gripper according to claim 5, wherein the axial rod is connected to both the first grip portion and the second grip portion by knuckle bearings.

8. The hand gripper according to claim 2, wherein the axial rod and the first grip portion are detachably assembled.

9. The hand gripper according to claim 8, wherein an assembly hole is formed in the first grip portion, the hand gripper further comprises a limiting block connected to the axial rod, the axial rod is configured to movably extend through the assembly hole, and the limiting block abuts against one side of the first grip portion away from the second grip portion in response to the axial rod and the locking member being locked.

10. The hand gripper according to claim 9, wherein a threaded polygonal socket is further formed in the limiting block, and the threaded polygonal socket is located in one side of the limiting block away from the axial rod.

11. The hand gripper according to claim 9, wherein the axial rod is connected to both the first grip portion and the second grip portion by knuckle bearings.

12. The hand gripper according to claim 1, wherein the axial rod and the first grip portion are detachably assembled.

13. The hand gripper according to claim 12, wherein an assembly hole is formed in the first grip portion, the hand gripper further comprises a limiting block connected to the axial rod, the axial rod is configured to movably extend through the assembly hole, and the limiting block abuts against one side of the first grip portion away from the second grip portion in response to the axial rod and the locking member being locked.

14. The hand gripper according to claim 13, wherein a threaded polygonal socket is further formed in the limiting block, and the threaded polygonal socket is located in one side of the limiting block away from the axial rod.

15. The hand gripper according to claim 13, wherein the axial rod is connected to both the first grip portion and the second grip portion by knuckle bearings.

16. The hand gripper according to claim 1, wherein the elastomer is a torsion spring, and the first grip portion and the second grip portion are fixedly connected to the torsion spring.

17. The hand gripper according to claim 16, wherein surfaces of both the first grip portion and the second grip portion are provided with anti-slip patterns.

18. The hand gripper according to claim 1, wherein surfaces of both the first grip portion and the second grip portion are provided with anti-slip patterns.

* * * * *